US008959856B2

(12) United States Patent
Völkner et al.

(10) Patent No.: US 8,959,856 B2
(45) Date of Patent: Feb. 24, 2015

(54) BUILDING ASSEMBLY WITH A CORNER PROFILE FOR AN INSULATING BUILDING SYSTEM

(75) Inventors: Stefan Völkner, Greve (DK); Preben Riis, Roskilde (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 13/381,484

(22) PCT Filed: Apr. 29, 2010

(86) PCT No.: PCT/EP2010/055796

§ 371 (c)(1),
(2), (4) Date: Dec. 29, 2011

(87) PCT Pub. No.: WO2011/000591

PCT Pub. Date: Jan. 6, 2011

(65) Prior Publication Data

US 2012/0102867 A1 May 3, 2012

(30) Foreign Application Priority Data

Jun. 29, 2009 (EP) ..... 09163988

(51) Int. Cl.

| | |
|---|---|
| ***E04B 1/00*** | (2006.01) |
| ***E04B 1/38*** | (2006.01) |
| ***E04B 1/02*** | (2006.01) |
| ***E04B 1/24*** | (2006.01) |

(52) U.S. Cl.

CPC ..... *E04B 1/24* (2013.01); *E04B 2001/2472* (2013.01); *E04B 2001/2481* (2013.01)

USPC ..... 52/282.1; 52/586.1; 52/256

(58) Field of Classification Search

CPC ..... E04B 1/49; E04B 1/58; E04B 1/5825–1/5837; E04B 1/5806; E04B 1/7666

USPC ..... 52/586.1, 586.2, 330, 282.3, 254

See application file for complete search history.

(56) References Cited

U.S. PATENT DOCUMENTS

| | | | | | |
|---|---|---|---|---|---|
| 1,537,678 | A | * | 5/1925 | Jensen | 403/294 |
| 2,158,732 | A | * | 5/1939 | Shannon | 52/461 |
| 2,249,028 | A | * | 7/1941 | Mulderink | 52/284 |
| 3,310,917 | A | * | 3/1967 | Simon | 52/91.1 |
| 3,640,039 | A | * | 2/1972 | McKee et al. | 52/281 |
| 4,032,241 | A | * | 6/1977 | Martin | 403/173 |
| 4,196,555 | A | * | 4/1980 | Henges et al. | 52/588.1 |
| 4,385,850 | A | * | 5/1983 | Bobath | 403/205 |
| 4,557,091 | A | * | 12/1985 | Auer | 52/282.3 |

(Continued)

FOREIGN PATENT DOCUMENTS

| | | |
|---|---|---|
| EP | 0006756 A2 | 1/1980 |
| GB | 1563266 A | 3/1980 |

(Continued)

*Primary Examiner* — Elizabeth A Plummer

(74) *Attorney, Agent, or Firm* — Gifford, Krass, Sprinkle, Anderson & Citkowski, P.C.; Douglas L. Wathen

(57) ABSTRACT

The present invention concerns a building assembly comprising joining profiles provided with profile contact sides, a corner profile provided with corner profile contact sides, and insulation panels orientated in two planes wherein the joining profile contact sides and the corner profile contact sides are adapted for receiving opposite contact sides of the insulation panels, such that the insulation panels are retained between the corner profile and the joining profiles.

14 Claims, 10 Drawing Sheets

(56) References Cited

U.S. PATENT DOCUMENTS

| | | | | | |
|---|---|---|---|---|---|
| 4,645,374 | A | * | 2/1987 | Erickson et al. | 403/402 |
| 4,840,440 | A | * | 6/1989 | Dieter | 312/140 |
| 4,891,919 | A | | 1/1990 | Palibroda | |
| 5,007,222 | A | * | 4/1991 | Raymond | 52/586.1 |
| 5,018,327 | A | * | 5/1991 | Goebel et al. | 52/282.3 |
| 5,062,250 | A | * | 11/1991 | Buzzella | 52/586.2 |
| 5,226,755 | A | * | 7/1993 | Tweedt | 403/205 |
| 5,298,681 | A | * | 3/1994 | Swift et al. | 174/97 |
| 5,647,181 | A | * | 7/1997 | Hunts | 52/282.1 |
| 5,787,669 | A | * | 8/1998 | Bishop | 52/591.4 |
| 5,941,040 | A | * | 8/1999 | McAnallen et al. | 52/586.1 |
| 6,003,279 | A | * | 12/1999 | Schneider | 52/481.1 |
| 7,127,865 | B2 | * | 10/2006 | Douglas | 52/745.13 |
| 8,083,203 | B2 | * | 12/2011 | Fournier | 249/48 |
| 8,117,801 | B2 | * | 2/2012 | Jambois et al. | 52/748.1 |
| 2004/0134162 | A1 | | 7/2004 | Douglas | |
| 2007/0094992 | A1 | * | 5/2007 | Antonic | 52/656.1 |

FOREIGN PATENT DOCUMENTS

| | | | | | |
|---|---|---|---|---|---|
| WO | 84/01792 | A1 | | 5/1984 | |
| WO | WO 8401792 | A1 | * | 5/1984 | E04B 1/343 |
| WO | 00/26483 | A1 | | 5/2000 | |
| WO | 2004/076764 | A1 | | 9/2004 | |

* cited by examiner

EXTERNAL CORNER

INNER CORNER

EXTERNAL CORNER.

INNER CORNER window

INNER AND EXTERNAL CORNER.

BUILDING ASSEMBLY WITH A CORNER PROFILE FOR AN INSULATING BUILDING SYSTEM

CROSS-REFERENCE TO RELATED APPLICATIONS

This application is the U.S. National Phase of PCT/EP2010/055796 filed Apr. 29, 2010, which claims priority of European Patent Application 09163988.0 filed Jun. 29, 2009.

FIELD OF THE INVENTION

The present invention relates to a building assembly with a corner profile.

BACKGROUND OF THE INVENTION

In WO 00/26483 a method and a profile for connecting building blocks is described resulting in a wall in a building system. According to this method, two construction blocks are joined along an edge face of each block abutting each other by a profile having a web and two flanges on each side with a perpendicularly extending flap at the distal ends of these two flanges. These flaps are inserted into a groove in the construction blocks whereby the blocks are held together.

This method is advantageous since prefabricated construction blocks may be provided off site and transported to the building site together with other materials and may be assembled on the building site. However, if the rectangular frame is subjected to a twisting force, the gripping flanges may slide out of the slits in the insulation making the entire building system unstable.

In WO 2004/076764 a joining device for joining building boards is described wherein a sandwich-construction is provided by covering panels and an insulation layer enclosed thereby. According to the device a wood material body, bonded to at least one of the covering panels, can be inserted between the building boards. Further, the disclosed joining device may be used in connecting two building boards in a right angle using U-shaped bars, having a base element and two legs abutting the covering panels of the building boards.

This method is advantageous since connecting two building boards in a right angle using U-shaped bars may form a construction wherein weight is supported by both the U-shaped bars and the covering panels. However, in some situations it is not desirable to have weight supported by both the U-shaped bars and the covering panels and in addition, the joining device disclosed in WO 2004/076764 is not well protected against thermal and acoustic bridging.

SUMMARY OF THE INVENTION

By the present invention it is realised that a building structure may be provided utilising this connecting method, disclosed in WO 00/26483, for both internal as well as external building structures. Further, it is realised that corners of said building structure may be provided utilising U-shaped bars as disclosed in WO 2004/076764.

Accordingly, in one aspect of the invention, there is provided a building assembly for an insulation building system, such as a wall, roof, ceiling or floor structure, said building assembly having an internal side and an external side and said building assembly comprising first and second joining profiles provided with first and second joining profile contact sides, a corner profile provided with at least first and second corner body portions, said corner body portions comprising associated first and second corner profile contact sides, first insulation panels orientated in a first plane between the first joining profile and the corner profile, and second insulation panels orientated in a second plane between the second joining profile and the corner profile, said second plane being different from said first plane, wherein, respectively, the first and second joining profile contact sides and the associated first and second corner profile contact sides are adapted for receiving opposite contact sides of the first and second insulation panels, said opposite contact sides being provided with a shape matching the contact side surfaces, such that the first and second insulation panels are retained between the corner profile and the first and second joining profile, respectively, and wherein said matching shape comprises at least one corner profile contact side comprising a flange portion adapted for engagement with an associated groove portion provided by the insulation panel.

The corner profile may be used in corners formed by two walls meeting or where two or more walls intersect, such as two walls intersecting or meeting in a 3-way junction, such as a T intersection.

In a preferred embodiment, the building assembly comprises at least one frame profile, such as two frame profiles arranged opposite each other peripherally on the building structure, such as a top and a bottom profile; a plurality of joining profiles between said oppositely arranged frame profiles, said joining profiles having a first and second side surfaces which are abutted by the first and second contact sides, respectively, of adjacent insulating panels on each side of said joining profiles, and wherein the opposite profile contact sides of the insulation panels are provided with a shape matching the first and second profile side surfaces, respectively, such that the insulation panels are retained between two profiles.

The building assembly may be used in a self-supporting system for an internal or external wall, floor, ceiling or roof in a building structure. In a vertically arranged building structure according to the invention, it is found that by providing preformed insulation panels between the corner and joining profiles, the corner and joining profiles are prevented from buckling due to the compression load, since the insulation panels are not only retained at the first set of opposite sides abutting the adjacent corner and joining profiles but are also retained by the frame profiles at the other peripheral sides. By an assembly according to the invention, the form stability in the insulation panel, such as but not limited to mineral fibrous insulation material, is utilised to prevent displacement in the building structure.

By an assembly according to the invention, it is realized that a fast installation time on the building site may be achieved. Moreover, it is a cost-effective and simple solution with a high degree of flexibility, as the system according to the invention may be used for different building applications.

In a preferred embodiment, the corner profile is at least partly covered on the external side by at least one covering insulation portion. Hereby, thermal bridging and acoustic bridging will be reduced significantly. Moreover the covering insulation portion may protect the corner profile in case of fires or the like.

In one embodiment, the covering insulation portion comprises a flex zone, by which tight junctions, such as tight junctions between a covering insulation portion and an insulation panel, are achieved next to the corner profiles.

A flex zone/flexible zone is a portion of an insulation panel or a covering insulation portion made less rigid during the manufacture, e.g. by pressing rollers into the zone and moving them along the edge. This has the advantage that this zone is compressible and may be compressed in order to provide a tight junctions, such as junctions between insulation portions, or in order to fit between the rafters and beams of a building structure. Further, the need for different formats of panels is reduced by using a flexible zone comprising a flexible section along one side of the insulation panel or the covering insulation portion.

A flex zone may be provided by softening the respective side by compressing or stretching the edge portion during manufacture and thereby reducing the fibre bonding in the flexible section. Hereby, the fibre bondings are partly broken making the fibrous insulation element flexible without reducing the density and without significantly influencing the thermal insulation properties.

In another embodiment, the first and/or the second insulation panel may be integrally provided with at least one covering insulation portion. This is advantageous, because the number of insulation slabs is thereby reduced and as a result thermal bridging and acoustic bridging may be further reduced.

In one embodiment, the first and second corner profile contact sides comprise flange portions extending from an exterior side of a hollow body portion, and the hollow body portion may have a rectangular, triangular, polygonal or round cross sections. The hollow body portion may comprise insulation material, whereby the building assembly is further isolated.

In another embodiment, the first corner body portion is adapted for engagement with the second corner body portion, whereby an angle is formed between the first and second corner body portion. The angle formed is preferably equal to the angle of the corner of the corresponding building structure. In a related embodiment, the first corner body portion is adapted for pivotal engagement with the second corner body portion. This is an advantage since the configuration of the corner profile may thereby easily be adapted for corners having different angles. Further, in another related embodiment, the first corner body portion is hinged with the second corner body portion.

The insulation panels are preferably made of a mineral fibre wool material with a density between 30-150 kg/m$^3$, preferably 50-125 kg/m$^3$, more preferably 60-100 kg/m$^3$. Mineral fibre wool panels, such as stone wool fibre panels, are advantageous since a non-combustible building system is thereby provided. However, it is realised that other materials could be used, such as polystyrene foam, polyisocyanurate resin, wood-fibre insulation or the like.

By the present invention, it is found that the insulation panels may have a total thickness ranging from 75 mm to 500 mm. Hereby also modern insulation requirements for domestic housings can be met by a building system according to the invention. In one embodiment, each insulation panel consists of one insulation slab. However, the invention may in one embodiment be used with an arrangement of double or multiple layers of insulation slabs, e.g. each insulation panel may comprise two or more insulation slabs provided in a stacked and/or layered configuration, whereby the total thickness of the insulation panel becomes roughly the sum of the thicknesses of the provided insulation slabs, which is suitable in particular for large thicknesses of insulation. Further, for large thicknesses of insulation, the corner and joining profile may comprise fixing means, like claws or clamps, that may be bent out from the body portion of the profiles to secure the different insulation layers.

Preferably, the side surfaces of the corner profiles and the corresponding contact surfaces on the insulation panels are shaped such that an insulation panel retaining is provided. In particular, the corner profiles are advantageously provided with retention profile members at both the first and second side of the partitioning assembly and preferably at least one of retention profile members of the corner profiles are adapted for subsequent mounting. In a particular embodiment, the corner profile comprises corner body portions which are generally I- or H-shaped. I- and H-shaped profiles are similar when rotated, although in practice there is distinguished between both due to the proportions of the flanges in relation to the body. By such suitable shape of the profile, the insulation panels are accommodated in the profile frame structure and prevented from being displaced, e.g. by a twist in the frame structure. By the invention it is realised that other suitable shapes may be used, such as C-shaped, U-shaped or Z-shaped profiles or combinations thereof. Moreover, it is also realised that profile assemblies may be provided e.g. for increased structural strength. Examples of such profile assemblies are shown in the FIGS. 13-19.

The first and/or second joining profile contact sides and/or the first and/or second corner profile contact sides may comprise a portion bent in one piece or otherwise formed from sheet metal. For instance, at least one corner profile may comprise corner profile contact sides comprising flange portions, which are preferably made of sheet metal, such as galvanised steel, preferably with a thickness of 0.5-4 mm. The flange portions may be provided with a thickness which is at least 50% greater than the thickness of an associated body portion provided between them. Further, the first and/or second corner profile contact sides may extend from an exterior side of a hollow body portion. In addition, the flange portions may be formed by a double-layered sheet portion with a single-layered body portion therebetween. In one embodiment, at least one corner profile contact side extends substantially perpendicular from an exterior side of the corner body portion. Further, the flange portions may be bent or otherwise formed from sheet metal. In a preferred embodiment, the thickness of the sheet metal is approx. 0.75 mm. More preferably the sheet metal may have a thickness of 0.5-4 mm and yet more preferably 0.7-1.5 mm, in particular 0.6 mm, 0.8 mm, 1 mm or 1.2 mm.

The body portion of the corner profile may have additional holes, such as apertures, openings or slits. These may prove advantageous in reducing the thermal conductivity of the corner profiles.

According to an embodiment of the invention, the corner profiles are made of wood. Hereby, the thermal conductivity is reduced due to the low thermal conductivity of the material. In another embodiment, the corner profiles are made of reinforced plastic or steel.

Preferably, a first cover structure is provided on the first side of the assembly, and a second cover structure on said second side thereof.

In an embodiment, the second cover structure may be a climate shield cover, such as an insulated outer wall system. Hereby, a low energy solution having high thermal insulation properties is provided when using the system according to the invention for an external building structure.

BRIEF DESCRIPTION OF THE DRAWINGS

The invention is further explained in the following under reference to the accompanying drawings in which:

FIG. 12 is a schematic horizontal cross section view of a building assembly showing a corner profile and two joining profiles with insulation panels between;

DETAILED DESCRIPTION OF THE PREFERRED EMBODIMENTS

Figure 1:
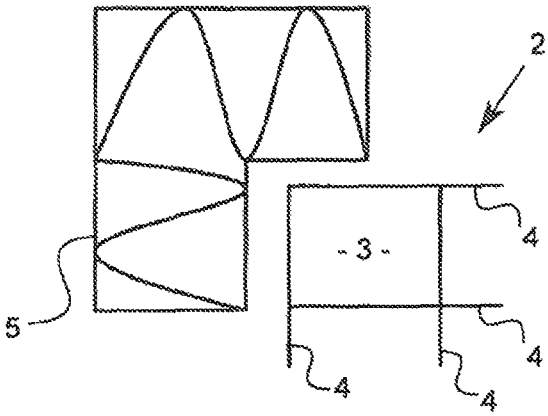
FIG. 1 is a schematic horizontal cross section view of a corner profile according to the invention and a covering insulation portion.
Figure 2:
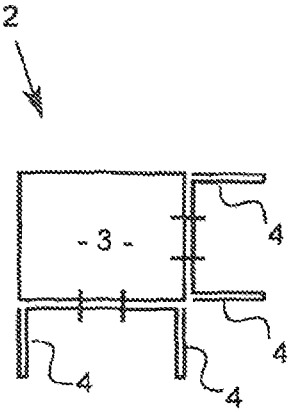
FIG. 2 is a schematic horizontal cross section view of a corner profile according to one embodiment.
Figure 3:
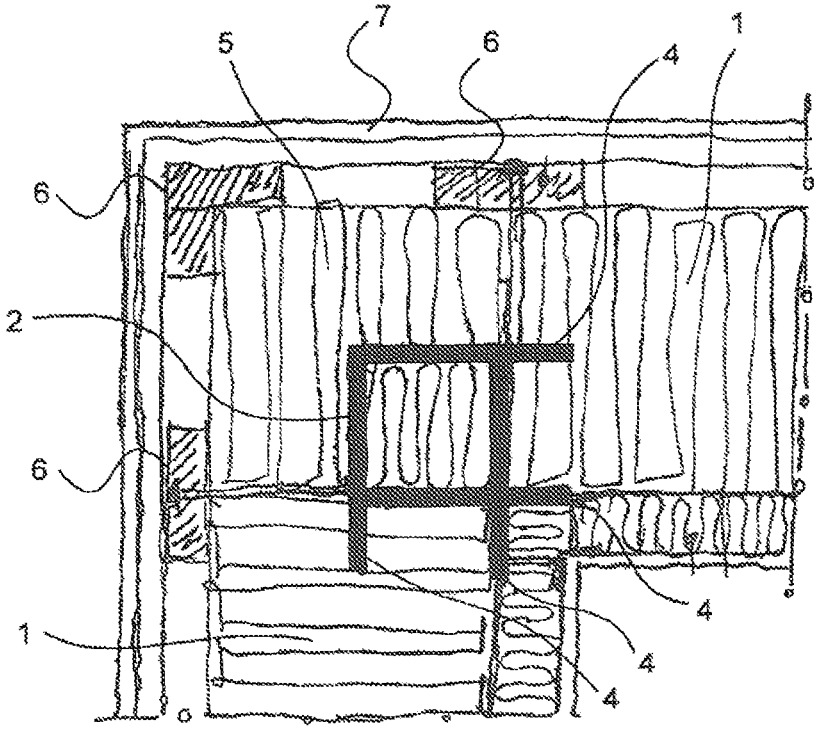
FIG. 3 is a schematic horizontal cross section view of a building assembly with a corner profile.
Figure 4:
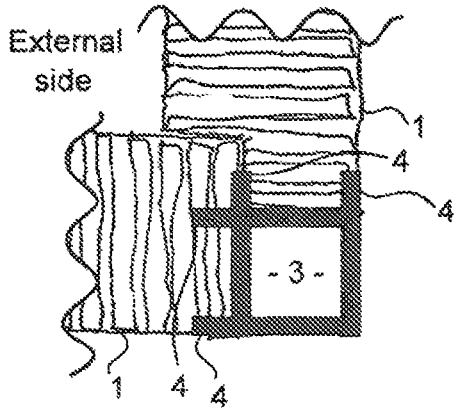
FIG. 4 is a cross sectional view of a building assembly showing a first embodiment of a corner profile.
Figure 5:
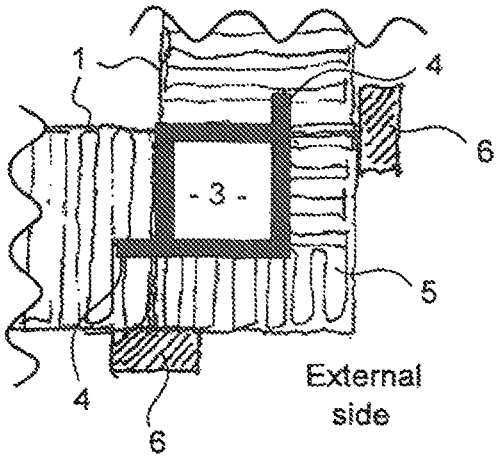
FIG. 5 is a cross sectional view of a building assembly showing a second embodiment of a corner profile.
Figure 6:
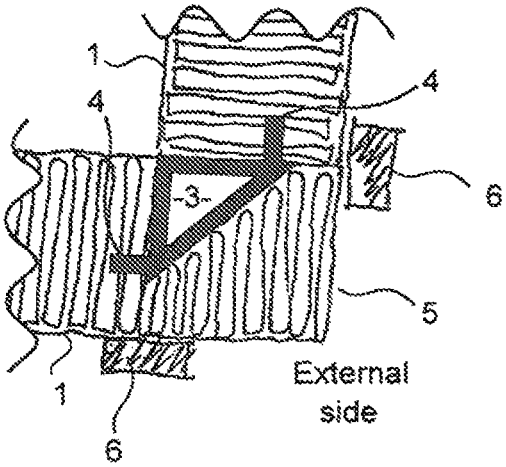
FIG. 6 is a cross sectional view of a building assembly showing a third embodiment of a corner profile.
Figure 7:
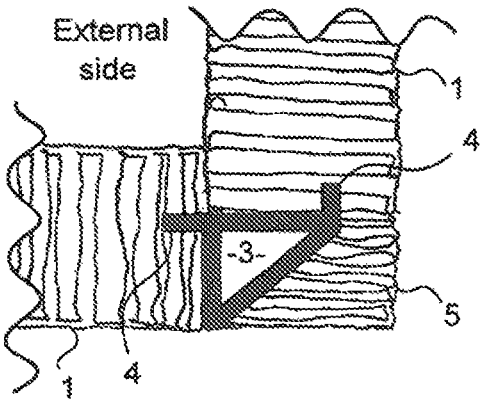
FIG. 7 is a cross sectional view of a building assembly showing a fourth embodiment of a corner profile.

With reference to FIGS. 1-3, there is shown embodiments of a corner profile 2 with a hollow rectangular body portion 3 having four corner profile contact sides comprising flange portions 4 extending perpendicular from the body portion 3 and matching associated groove portions provided by corresponding insulation panels 1. Two or more of the flange portions 4 may be bent in one piece or otherwise formed from sheet metal and connected to the hollow body portion 3 by a suitable attachment, such as weldings, gluing or the like, cf. FIG. 2. With reference to FIG. 3, a corner profile 2 is shown with a covering insulation portion 5, for reducing thermal and acoustic bridging, and building elements 6 which may be connected to the corner profile 2. The building elements 6 may support a stiffening external cladding or bracing 7. The insulation panels 1 may have a high wool density, preferably in the range of 60-100 kg/m$^3$, and may support the corner profile 2, by strong lateral forces, such that the corner profile 2 is less susceptible to bending.

With reference to FIGS. 4, 5, 6, and 7, building assemblies having corner profiles with corner profile contact sides comprising flange portions 4 and hollow body portions 3, having rectangular or triangular shapes, are shown in four embodiments.

Figure 8:
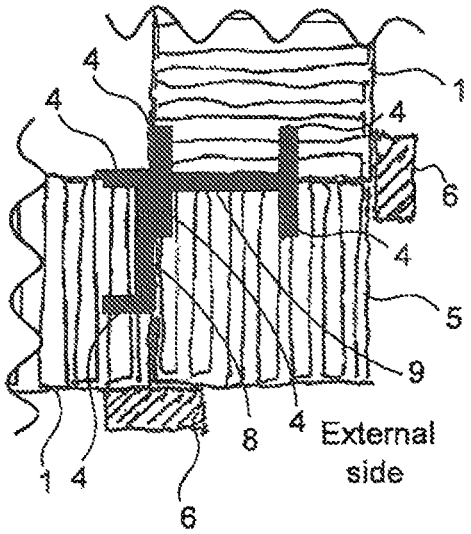
FIG. 8 is a cross sectional view of a building assembly showing a fifth embodiment of a corner profile.

With reference to FIGS. 8, 9, 10, and 11, building assemblies having corner profiles comprising C- or U-profiles and I- or H-profiles are shown in four embodiments. With reference to FIG. 8, the corner profile is formed by first and second corner body portions 8, 9 connected in a right angle. The first corner body portion 8 comprises two associated first corner profile contact sides comprising flange portions 4, such that the first corner body portion 8 has a C-shape. The second corner body portion 9 comprises four associated second corner profile contact sides comprising flange portions 4, such that the second corner body portion 9 has an I-shape.

Figure 9:
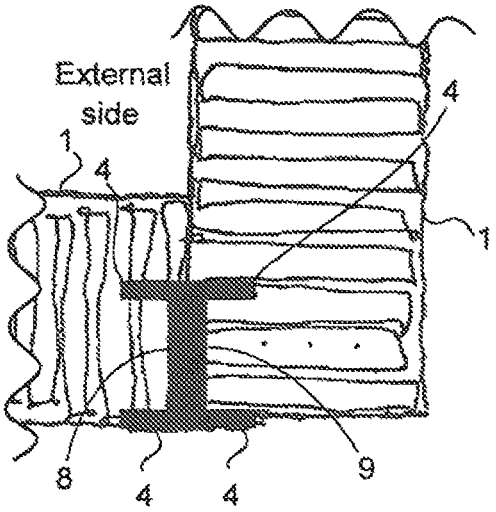
FIG. 9 is a cross sectional view of a building assembly showing a sixth embodiment of a corner profile.

With reference to FIG. 9, the corner profile is formed by first and second corner body portions 8, 9 each comprising two associated corner profile contact sides comprising flange portions 4, such that each of the two corner body portions has a C-shape. Alternatively, the corner profile may be formed as one corner body portion comprising four associated corner profile contact sides comprising flange portions 4, such that the corner body portion has an I-shape.

Figure 10:
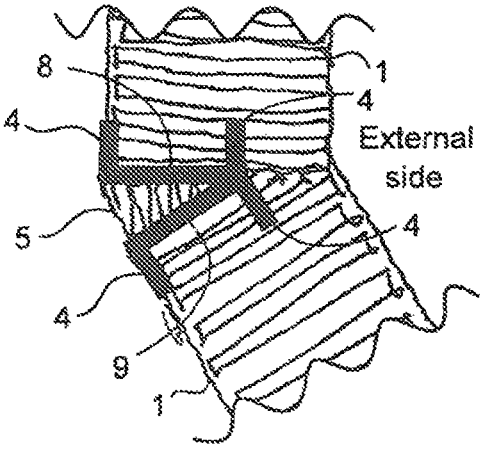
FIG. 10 is a cross sectional view of a building assembly showing a seventh embodiment of a corner profile.
Figure 11:
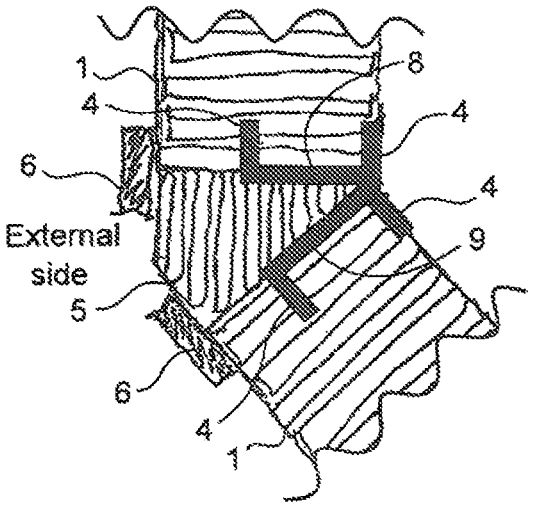
FIG. 11 is a cross sectional view of a building assembly showing an eighth embodiment of a corner profile.

With reference to FIGS. 10 and 11, corner profiles are formed by first and second corner body portions 8, 9 each comprising two associated corner profile contact sides comprising flange portions 4, such that each of the two corner body portions has a C-shape. In an alternative embodiment, the corner body portions may have a U-shape. The corner body portion 8 is connected to the corner body portion 9, such that an angle is formed between them. The connection may be formed by hinging, whereby a corner profile may easily be adapted for different corner angles.

Figure 12:
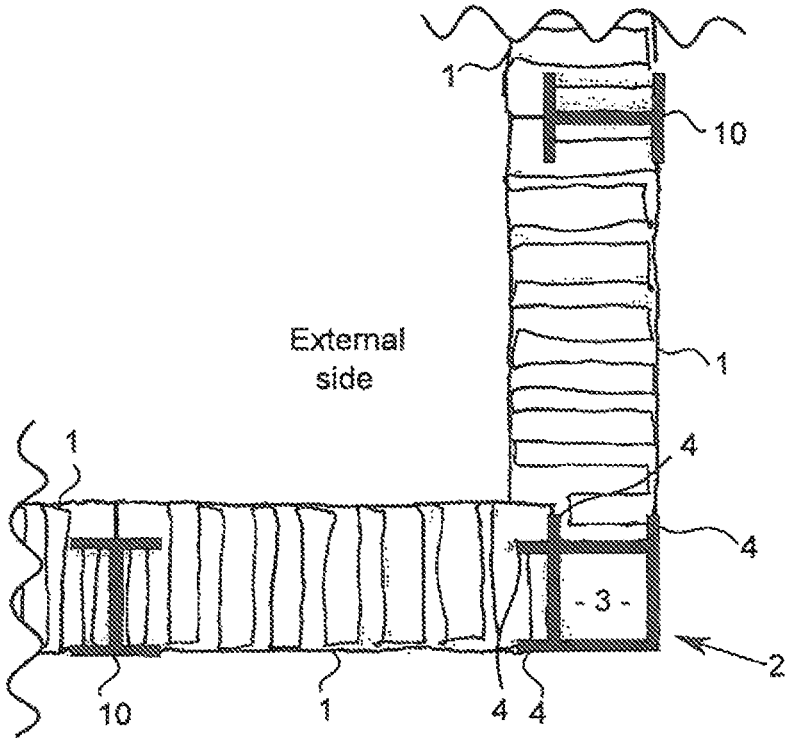

With reference to FIG. 12, there is shown another embodiment of a building assembly having two joining profiles 10, a corner profile 2 with a hollow body portion 3, and insulation panels 1 between the joining profiles 10 and the corner profile 2. The insulation panels 1 may support the corner profile 2 and the joining profiles 10, by strong lateral forces, such that the corner profile 2 and the joining profiles 10 are less susceptible to bending.

Figure 13:
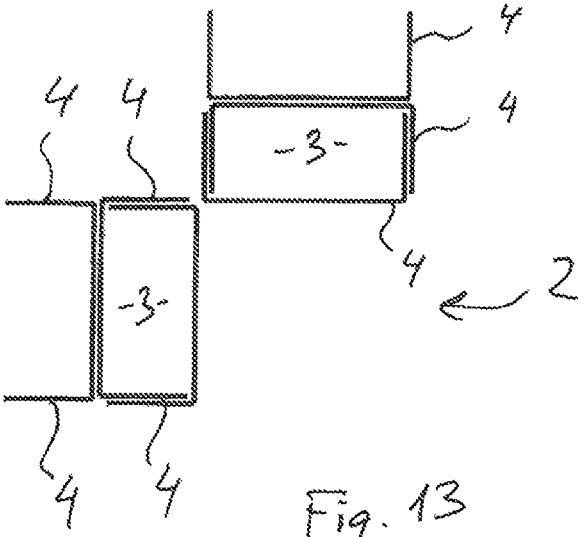
FIG. 13 is a schematic cross-section view of another embodiment of a corner profile according to the invention.
Figure 14:
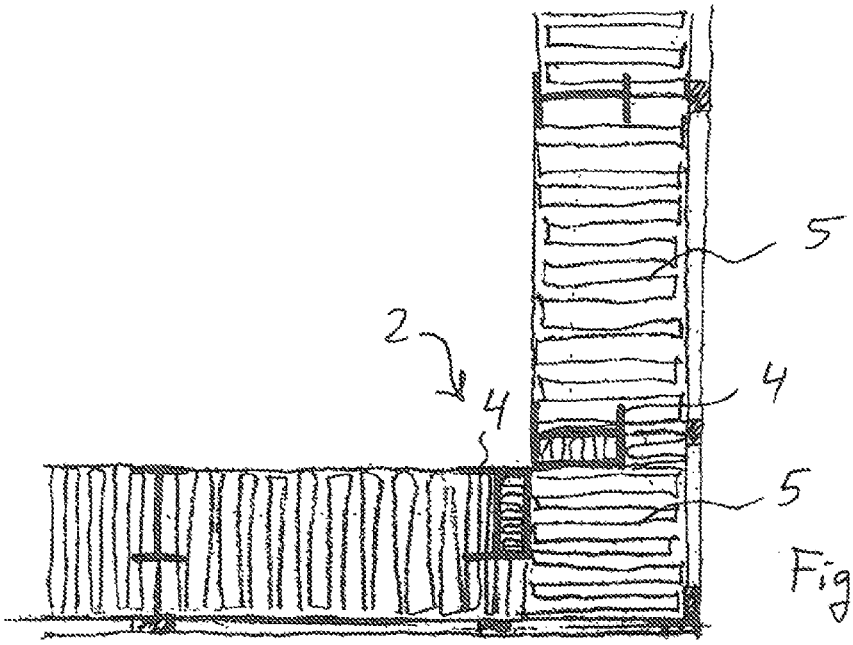
FIG. 14 is a cross-section view of a building assembly with a corner profile of FIG. 13.

FIGS. 13 to 19 show various other embodiments of corner or termination profiles according to the invention. In FIG. 13 there is schematically shown an example of a corner profile 2 which is made up by two times six U- and/or C-shaped profiles making up a hollow profile section 3 on each corner side by two oppositely arranged U and/or C profiles with flanges 4 facing each other and each with a third U or C profile in a back to back arrangement with one of these profiles and comprising distal flange portions 4 penetrating into the insulation panels. FIG. 14 illustrates an example of an external corner building assembly with this corner profile assembly shown in FIG. 13. If required, the two hollow profile sections 3 may be fixedly connected or hinged at their common point of contact as to form the corner profile 2.

Figure 15:
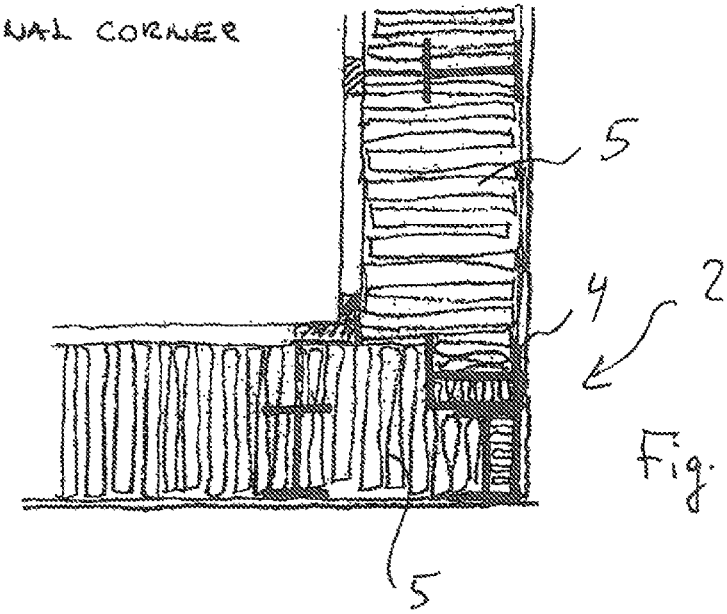
FIG. 15 is a cross-section of a further embodiment of a building assembly according to the invention.

In FIG. 15 an example of an inner corner is shown, where the corner profile assembly is also made up by a number of U shaped profiles but in a different configuration than in FIG. 14 so that it is ensured that the profiles are arranged on the inside of the wall section in the building assembly, hereby preventing thermal bridging.

Figure 16:
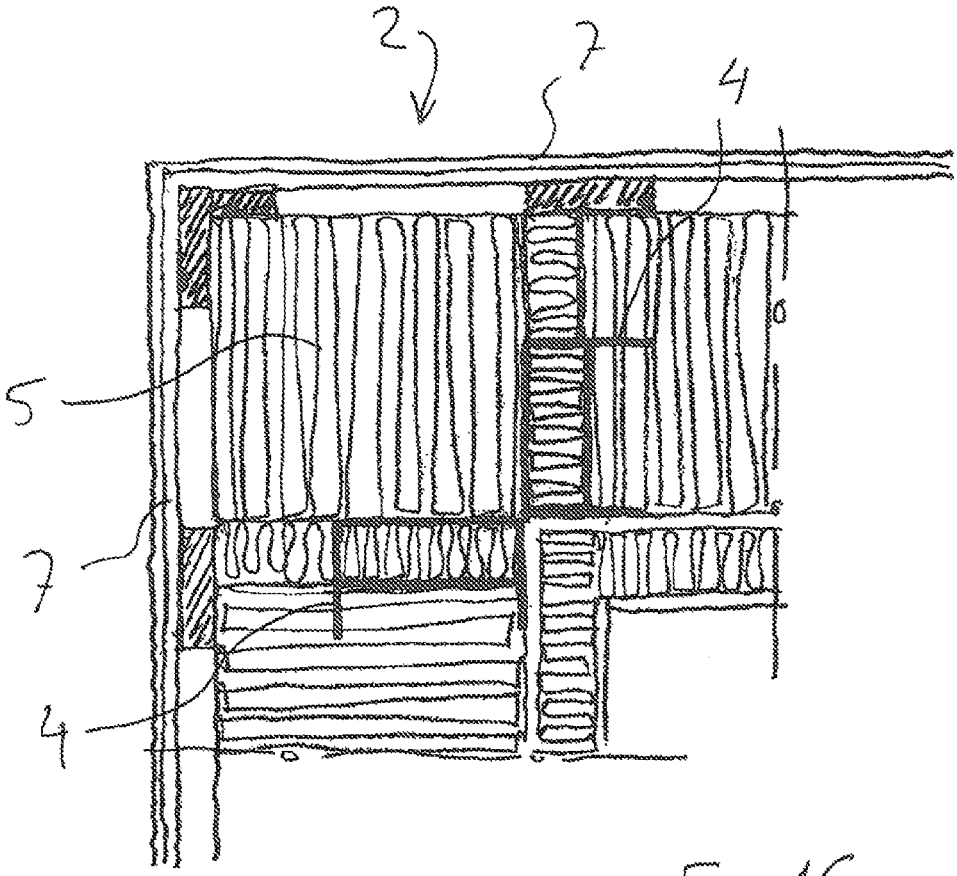
FIG. 16 is a cross-section of an embodiment of an external corner in a building assembly of the invention.

In FIG. 16 is shown a cross-section of an embodiment of an external corner in a building assembly of the invention similar to the corner assembly shown in FIG. 14 but with an extra insulation panel layer on the inside. As can easily be seen from this drawing the hollow profile section 3 may as an alternative also be build from one single rectangular profile instead of two oppositely arranged U or C profiles.

Figure 17:
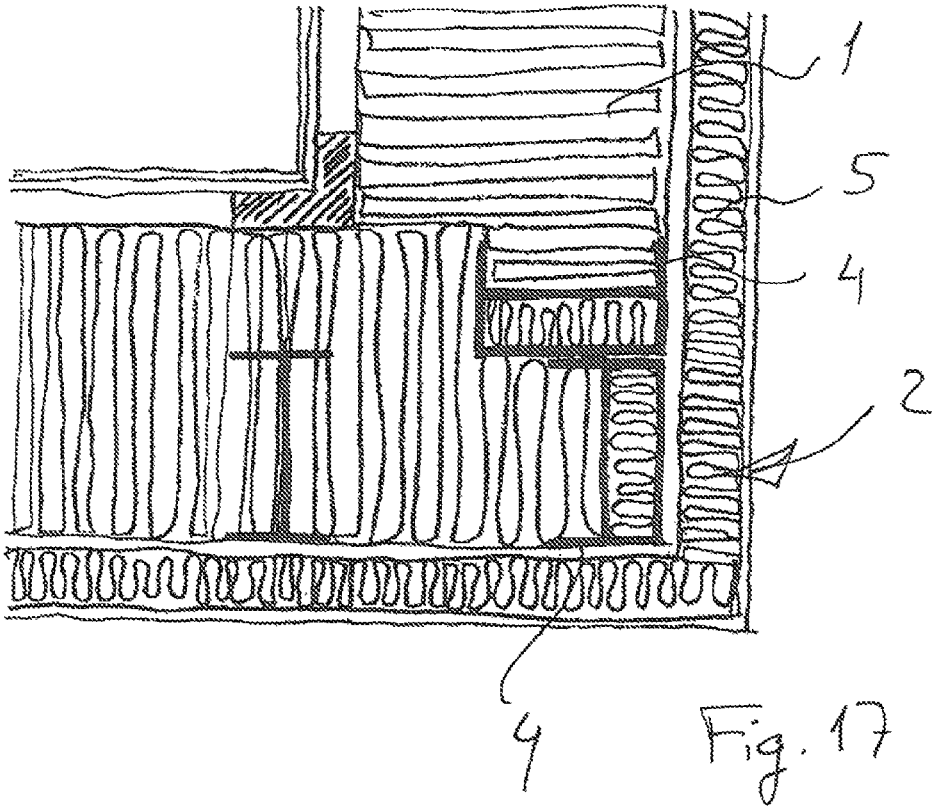
FIG. 17 is a cross-section of an embodiment of an inner corner in a building assembly of the invention.

Similarly, in FIG. 17 there is shown a cross-section of an inner corner in a building assembly of the invention similar to the corner shown in FIG. 15 but with an additional internal layer of insulation thereon.

Figure 18:
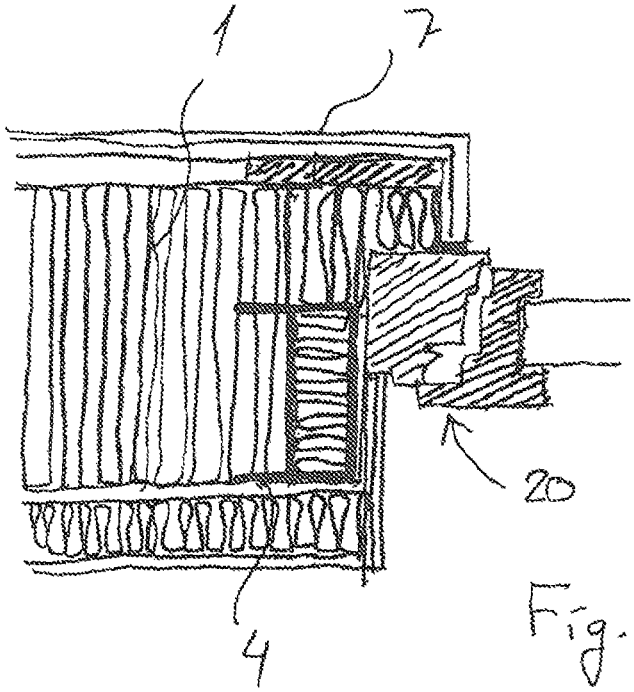
FIG. 18 is a cross-section of an embodiment of a window or similar frame termination of a wall according to a building assembly of the invention.

In FIG. 18 there is shown a cross-section of an embodiment where the wall section is provided with a building opening such as a window, door or similar frame termination 20, since it is realised by the invention that the corner profile can also be used as a termination profile in the area of building openings providing suitable possibilities for the fixation of e.g. window and/or door frames 20.

Figure 19:
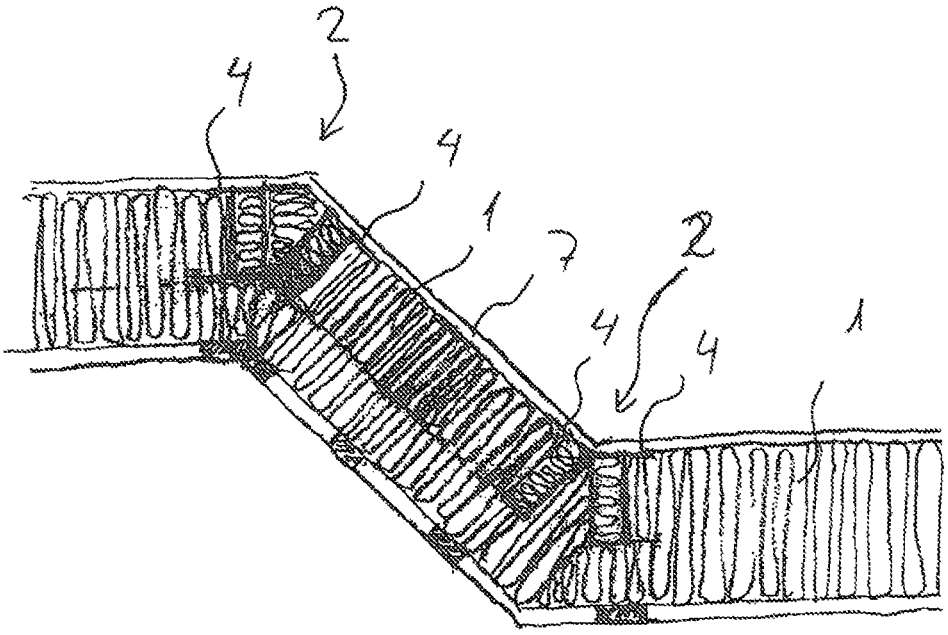
FIG. 19 is a cross-section of an embodiment of both an external corner and an inner corner in a building assembly of the invention.

In FIG. 19 variants of the corner profile assembly of U- and/or C-shaped profiles are shown. Accordingly, both an external corner and an inner corner in a building assembly of the invention are shown where the corner is different than 90 degrees.

As illustrated in the FIGS. 13-19 it is found advantageous to provide the corner profile as a profile assembly made up by a plurality of U- and/or C-shaped profile sections which are sub-assembled to suit the actual corner in the building design. Said plurality of profile sections may be fixedly attached to each other by e.g. screws, rivets, welding, gluing or other suitable means or methods. An advantage by these embodiments is that due to structural considerations, the corner profiles can be modified to increase their strength.

The building assembly according to the invention may be used as a part of a insulating building system in a building structure where top and bottom frame profiles are joined by a plurality of joining profiles wherein insulation panels are retained between frame profiles, joining profiles and/or corner profiles and wherein corner and joining profiles have flange portions adapted for matching insulation panels with corresponding profile contact sides. When mounted, the insulation panels support the joining and corner profile by strong lateral forces, such that the corner profile and joining profile are less susceptible to bending.

Above, some embodiments currently considered advantageous are described. However, by the invention it is realised that other advantageous embodiments may be provided without departing from the scope of the invention as set forth in the accompanying claims. For instance, any of the structures shown in the embodiments above may be used with different orientations, vertically, horizontally or inclined, and may also be used for either internal or external partitioning building structures in a building.

The invention claimed is:

1. A building assembly for an insulation building system, said building assembly having an internal side and an external side and said building assembly comprising:

first and second joining profiles provided with first and second joining profile contact sides;

a corner profile having at least one hollow body portion and first and second corner profile contact sides;

first insulation panels orientated in a first plane between the first joining profile and the corner profile;

and second insulation panels orientated in a second plane between the second joining profile and the corner profile, said second plane being different from said first plane;

wherein the first and second insulation panels are formed of mineral fiber wool and at least one of the first and second insulation panels having a covering insulation portion extending therefrom and formed of mineral fiber wool;

wherein, respectively, the first and second joining profile contact sides and the corresponding first and second corner profile contact sides are adapted for receiving opposite contact sides of the first and second insulation panels, said opposite contact sides being provided with a matching shape corresponding to the contact side surfaces, such that the first and second insulation panels are retained between the corner profile and the first and second joining profile, respectively; and wherein said matching shape comprises at least one corner profile contact side comprising a flange portion, adapted for engagement with a corresponding groove portion provided by the insulation panel; and wherein the entirety of the corner profile is covered on the external side by at least one covering insulation portion of the at least one of the first and second insulation panels such that the corner profile extends from the internal side of the building assembly part way to the external side of the building assembly and the corner profile does not bridge from the internal to the external side of the building assembly; and wherein at least one of the at least one of the first and second joining profile contact sides, and the at least one of the first and second corner profile contact sides comprises a portion formed in one piece from sheet metal.

2. A building assembly according to claim 1, comprising at least two frame profiles arranged opposite each other peripherally on the building structure;

said first and second joining profiles being disposed between said at least two frame profiles;

said joining profiles having a first and second side surfaces which are abutted by the first and second contact sides, respectively, of adjacent insulating panels on each side of said joining profiles, and wherein the opposite profile contact sides of the insulation panels are provided with a shape matching the first and second profile side surfaces, respectively, such that the insulation panels are retained between said at least two frame profiles.

3. A building assembly according to claim 1, wherein said first or second corner profile contact sides extend from an exterior side of the hollow body portion.

4. A building assembly according to claim 3, wherein the hollow body portion has a rectangular or triangular cross section.

5. A building assembly according to claim 1, wherein the at least one hollow body portion is a first corner body portion, the corner profile further comprising a second corner body portion, an angle being formed between the first and second corner body portion.

6. A building assembly according to claim 5, wherein the first corner body portion is pivotally engaged with the second corner body portion.

7. A building assembly according to claim 5, wherein the first corner body portion is hinged with the second corner body portion.

8. A building assembly according to claim 5, wherein at least one of the corner body portions is generally U- or C-shaped.

9. A building assembly according to claim 1, wherein at least one of the corner profile contact sides extends substantially perpendicular from an exterior side of the hollow body portion.

10. A building assembly according to claim 1, wherein the hollow body portion is provided with holes.

11. A building assembly according to claim 1, wherein at least one of the corner profile contact sides comprises a flange portion made of sheet metal.

12. A building assembly according to claim 11, wherein the sheet metal has a thickness of approximately 0.5-4 mm.

13. A building assembly according to claim 1, wherein the insulation panels are preformed mineral fiber wool insulation panels that prevent buckling of the corner and joining profiles under compression load.

14. A building assembly for an insulation building system, said building assembly having an internal side and an external side and said building assembly comprising:

first and second joining profiles provided with first and second joining profile contact sides;

a corner profile having at least one hollow body portion and first and second corner profile contact sides;

first insulation panels orientated in a first plane between the first joining profile and the corner profile;

and second insulation panels orientated in a second plane between the second joining profile and the corner profile, said second plane being different from said first plane;

wherein the first and second insulation panels are formed of mineral fiber wool;

wherein, respectively, the first and second joining profile contact sides and the corresponding first and second corner profile contact sides are adapted for receiving opposite contact sides of the first and second insulation panels, said opposite contact sides being provided with a matching shape corresponding to the contact side surfaces, such that the first and second insulation panels are retained between the corner profile and the first and second joining profile, respectively; and wherein said matching shape comprises at least one corner profile contact side comprising a flange portion, adapted for engagement with a corresponding groove portion provided by the insulation panel; and wherein the entirety of an internal or external side of the corner profile is covered by a portion of at least one of the mineral fiber wool insulation panels such that the corner profile extends from the internal side of the building assembly part way to the external side of the building assembly and the corner profile does not bridge from the internal to the external side of the building assembly; and wherein at least one of the at least one of the first and second joining profile contact sides, and the at least one of the first and second corner profile contact sides comprises a portion formed in one piece from sheet metal.

* * * * *